US011591740B2

(12) United States Patent
Gallagher et al.

(10) Patent No.: US 11,591,740 B2
(45) Date of Patent: Feb. 28, 2023

(54) DISPENSING SYSTEM FOR A LAUNDRY TREATING APPLIANCE

(71) Applicant: WHIRLPOOL CORPORATION, Benton Harbor, MI (US)

(72) Inventors: Eric A. Gallagher, Kalamazoo, MI (US); James Jeffery, Saint Joseph, MI (US); Guy M. Kazmierzak, Dowagiac, MI (US); Eric Osler, Mishawaka, IN (US); Bruno T. Ramasco, Stevensville, MI (US); Guy Stormo, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 144 days.

(21) Appl. No.: 16/145,259

(22) Filed: Sep. 28, 2018

(65) Prior Publication Data

US 2019/0234001 A1 Aug. 1, 2019

Related U.S. Application Data

(60) Provisional application No. 62/624,409, filed on Jan. 31, 2018.

(51) Int. Cl.
*D06F 39/02* (2006.01)
*D06F 39/08* (2006.01)

(52) U.S. Cl.
CPC ..... *D06F 39/022* (2013.01); *D06F 39/088* (2013.01)

(58) Field of Classification Search
CPC ..... D06F 39/02; D06F 39/022; D06F 39/083; D06F 39/088; D06F 33/34; D06F 33/36; D06F 33/37; D06F 33/54; D06F 33/56; D06F 33/57; D06F 2202/08; D06F 2204/08
See application file for complete search history.

(56) References Cited

U.S. PATENT DOCUMENTS

| | | | |
|---|---|---|---|
| 3,490,254 | A | 1/1970 | Mason |
| 6,353,954 | B1 | 3/2002 | Dunsbergen et al. |
| 7,313,932 | B2 | 1/2008 | Ryohke et al. |
| 7,493,781 | B2 | 2/2009 | Ooe |

(Continued)

FOREIGN PATENT DOCUMENTS

| | | | |
|---|---|---|---|
| CN | 203021787 | U | 6/2013 |
| DE | 202010017496 | U1 | 12/2011 |

(Continued)

OTHER PUBLICATIONS

Leslie Montes Design—Arc Tap; Available at https://lesliemontes.com/arc-tap; Accessed Sep. 27, 2018.

*Primary Examiner* — Marc Lorenzi
(74) *Attorney, Agent, or Firm* — McGarry Bair PC

(57) ABSTRACT

A laundry treating appliance with a treating chamber for receiving laundry for treating and a liquid supply system fluidly coupled to the treating chamber. The liquid supply system includes a water supply system and a dispensing system. The dispensing system includes a faucet, a support structure, one or more drawers, and one or more dispenser outlets for providing treating liquid and treating chemistries. Components of the dispensing system can be activated, e.g. for pretreating laundry items, for use as a utility sink, or during an automatic cycle of operation.

22 Claims, 7 Drawing Sheets

(56) References Cited

U.S. PATENT DOCUMENTS

| | | | | |
|---|---|---|---|---|
| 9,200,399 | B2 | 12/2015 | Kim et al. | |
| 9,217,215 | B2 | 12/2015 | Kim et al. | |
| 9,315,934 | B2 | 4/2016 | Kim et al. | |
| 9,702,077 | B2 | 7/2017 | Doh | |
| 2010/0000578 | A1* | 1/2010 | Hendrickson | D06F 39/028 134/34 |
| 2010/0147340 | A1* | 6/2010 | Hasse | D06F 39/022 134/56 R |
| 2014/0165663 | A1* | 6/2014 | Celotto | D06F 39/02 68/17 R |
| 2015/0247276 | A1 | 9/2015 | Kim et al. | |
| 2015/0252513 | A1* | 9/2015 | Seo | D06F 39/028 68/17 R |
| 2016/0102425 | A1 | 4/2016 | Scheckelhoff | |
| 2016/0237612 | A1* | 8/2016 | Ghosh | D06F 39/028 |
| 2016/0348293 | A1 | 12/2016 | Kawaguchi et al. | |
| 2017/0037558 | A1 | 2/2017 | Dunsbergen et al. | |
| 2017/0037559 | A1 | 2/2017 | Gallagher et al. | |
| 2017/0298560 | A1* | 10/2017 | Leibman | D06F 39/022 |

FOREIGN PATENT DOCUMENTS

| | | | | |
|---|---|---|---|---|
| EP | 2295624 | B1 | 5/2012 | |
| EP | 3192916 | A1 * | 7/2017 | D06F 39/022 |
| KR | 20170084455 | A | 7/2017 | |

* cited by examiner

DISPENSING SYSTEM FOR A LAUNDRY TREATING APPLIANCE

CROSS-REFERENCE TO RELATED APPLICATIONS

This application claims the benefit of U.S. Provisional Patent Application No. 62/624,409, filed Jan. 31, 2018, which is incorporated herein by reference in its entirety.

BACKGROUND

Laundry treating appliances, such as washing machines, typically include a rotatable drum defining a treating chamber in which laundry items are placed for treatment according to an automatic cycle of operation implemented by the appliance. Liquid, such as water or a mixture of water and one or more treating chemistries, is supplied to the treating chamber during the automatic cycle of operation to treat the laundry. The liquid is collected within a tub surrounding the drum and is either drained from the appliance or recirculated for application to the laundry items.

In some scenarios, it can be desirable to treat a laundry item by hand prior to or instead of treating the laundry item according to an automatic cycle of operation. The laundry treating appliance can include a faucet for dispensing water that is accessible by a user for pre-treating or hand washing a laundry item. The water dispensed by the faucet can be collected in the tub for subsequent draining from the appliance.

BRIEF SUMMARY

In one aspect, a laundry treating appliance and method of operating a laundry treating appliance includes a treating chamber receiving laundry for treatment, a dispenser having at least one treating chemistries reservoir fluidly coupled to the treating chamber or a dispensing system. The dispensing system configured to dispense water or a mixture of water and treating chemistries or treating chemistries. The dispensing system can be operated independent of the automatic cycle of operation or activated as a part of an automatic cycle of operation.

DESCRIPTION

Prior to running a cycle of operation for treating laundry items a user can desire to pre-treat laundry items to more effectively treat the laundry items. Pre-treating is typically performed in an external utility sink or space in a user's laundry room. However not all laundry rooms are equipped with an external utility sink or space. Integration of a water supply in accordance with the present disclosure enables a user to pre-treat laundry items without the use of an external sink or space. For example, pre-treatment can be achieved by providing a faucet fluidly coupled to a household water supply or dispenser drawer support structure and by coupling the faucet to a treating chamber. The faucet, or outlet thereof, can be provided on mechanical structures associated with the treating chamber or an access opening to the treating chamber, such as a shroud surrounding the access opening. However, the faucet or outlet can be provided on any mechanical structure accessible by a user and adjacent the treating chamber. The faucet can also be operated as part of an automatic cycle of operation.

Figure 1:
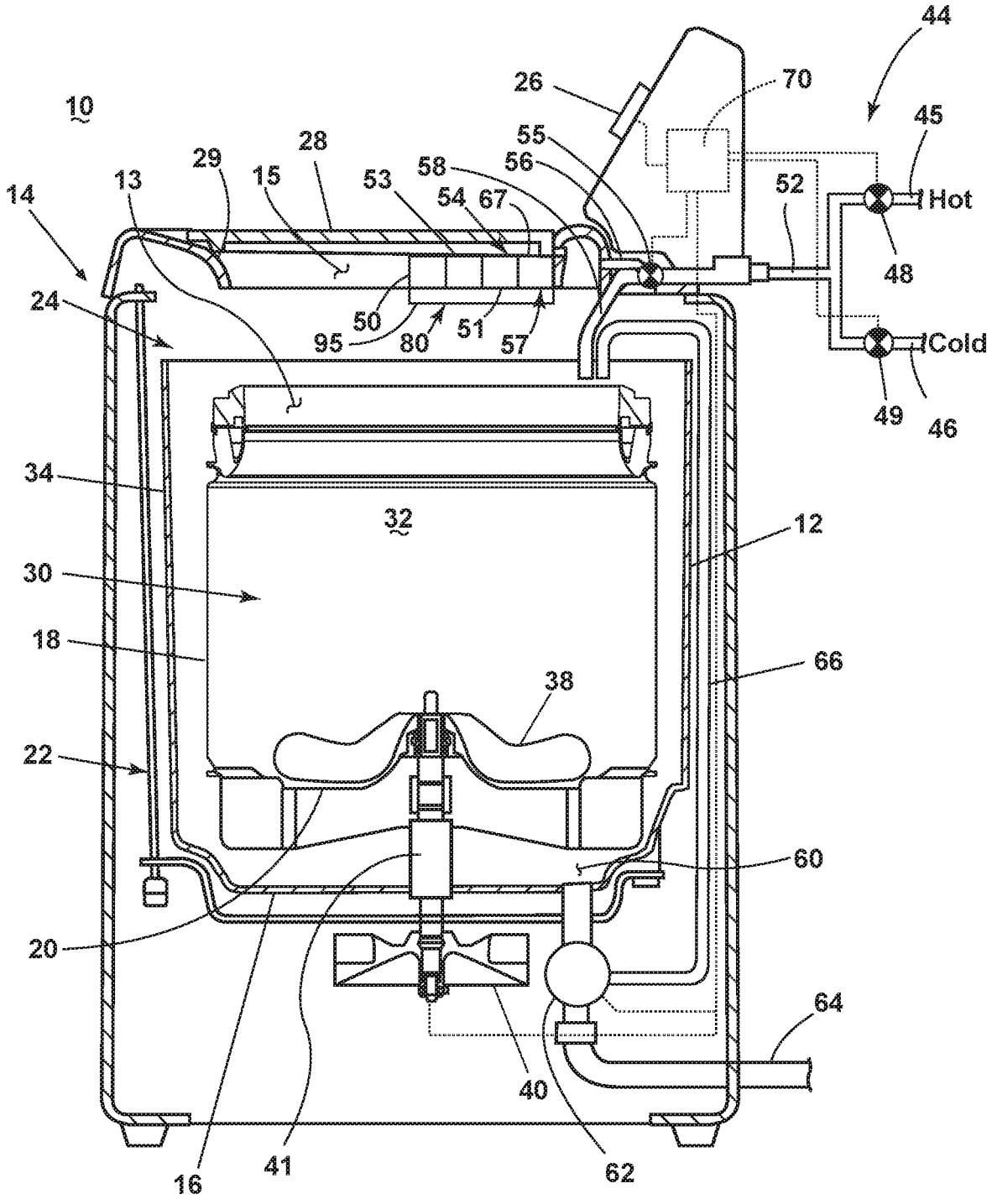
FIG. 1 is a schematic view of a laundry treating appliance in the form of a washing machine according to the present disclosure.

FIG. 1 is a schematic view of a laundry treating appliance according to an aspect of the disclosure herein. The laundry treating appliance can be any appliance which performs a cycle of operation to clean or otherwise treat items placed therein, non-limiting examples of which include a horizontal or vertical axis clothes washer or washing machine; a combination washing machine and dryer; a tumbling or stationary refreshing/revitalizing machine; an extractor; a non-aqueous washing apparatus; and a revitalizing machine.

As used herein, the term "vertical axis" washing machine refers to a washing machine having a rotatable drum that rotates about a generally vertical axis relative to a surface that supports the washing machine. However, the rotational axis need not be perfectly vertical to the surface. The drum can rotate about an axis inclined relative to the vertical axis, with fifteen degrees of inclination being one example of the inclination. Similar to the vertical axis washing machine, the term "horizontal axis" washing machine refers to a washing machine having a rotatable drum that rotates about a generally horizontal axis relative to a surface that supports the washing machine. The drum can rotate about the axis inclined relative to the horizontal axis, with fifteen degrees of inclination being one example of the inclination.

As illustrated in FIG. 1, the washing machine 10 can include a structural support system comprising a cabinet 14 that defines a housing, within which a laundry holding system resides. An access opening 15 can be provided in the cabinet 14 to access the laundry holding system. The cabinet 14 can be a housing having a chassis and/or a frame, to which decorative panels may or may not be mounted, defining an interior that receives components typically found in a conventional washing machine, such as motors, pumps, fluid lines, controls, sensors, transducers, and the like. Such components will not be described further herein except as necessary for a complete understanding of the disclosure.

The laundry holding system of the illustrated washing machine 10 can include a rotatable basket 30 having an open top 13 that can be disposed within the interior of the cabinet 14 and can define a treating chamber 32 for receiving laundry items for treatment. The open top can be aligned with the access opening 15. A tub 34 can also be positioned within the cabinet 14 and can define an interior 24 within which the basket 30 can be positioned. The tub 34 can have a generally cylindrical side or tub peripheral wall 12 closed at its bottom end by a base 16 that can at least partially define a sump 60.

The rotatable basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation and can include a plurality of perforations, such that liquid can flow between the tub 34 and the rotatable basket 30 through the perforations. While the illustrated washing machine 10 includes both the tub 34 and the basket 30, with the basket 30 defining the treating chamber 32, it is within the scope of the disclosure for the laundry treating appliance to include only one receptacle, with the receptacle defining the laundry treating chamber for receiving the load to be treated.

A shroud 29 is provided at the top of the cabinet 14 and can define the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34. A selectively openable lid 28 can provide access into the treating chamber 32 through the access opening 15 of the basket 30.

A laundry mover 38 can be rotatably mounted within the basket 30 to impart mechanical agitation to a load of laundry placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an impeller, an agitator, a wobble plate, and a hybrid impeller-agitator.

The basket 30 and the laundry mover 38 can be driven by a drive system 40 that includes a motor 41, which can include a gear case, operably coupled with the basket 30 and laundry mover 38. The motor 41 can rotate the basket 30 at various speeds in either rotational direction about the vertical axis of rotation. Spin speeds are commonly known for use in extracting liquid from the laundry items in the basket 30, such as after a wash or rinse step in a treating cycle of operation. A loss motion device or clutch (not shown) can be included in the drive system 40 and can selectively operably couple the motor 41 with either the basket 30 and/or the laundry mover 38.

A suspension system 22 can dynamically hold the tub 34 within the cabinet 14. The suspension system 22 can dissipate a determined degree of vibratory energy generated by the rotation of the basket 30 and/or the laundry mover 38 during a treating cycle of operation. Together, the tub 34, the basket 30, and any contents of the basket 30, such as liquid and laundry items, define a suspended mass for the suspension system 22.

A liquid supply system can include a water supply system 44 and a dispensing system 54. The water supply system 44 can be configured to supply hot or cold water. The water supply system 44 can include a hot water inlet 45, a cold water inlet 46, a valve assembly and various conduits. The valve assembly can include a hot water valve 48, a cold water valve 49, and a diverter valve 55. Components of the valve assembly couple to various conduits including, but not limited to, a supply conduit 52, a first water conduit or water inlet 56, and a second water conduit 58; which can provide selective distribution from the hot water inlet 45 and cold water inlet 46. The hot water valve 48 and cold water valve 49 are selectively openable to provide water, such as from a household water supply (not shown) to the supply conduit 52. The hot water and cold water valves 48, 49 can be opened individually or together to provide a mix of hot and cold water at a selected temperature. While the hot water and cold water valves 48, 49 and supply conduit 52 are illustrated exteriorly of the cabinet 14, it can be understood that these components can be internal to the cabinet 14.

The dispensing system 54 can be comprised of, but is not limited to, a faucet 53, a dispensing support structure 80, and one or more drawers 57. The one or more drawers 57 can include, define, or fluidly couple to at least one treating chemistry reservoir 67 for dispensing at least one treating chemistry. Additionally, the dispensing system 54 can include a fluid flow path 95 for directing water from the water inlet 56 through the dispensing support structure 80, a secondary user interface 50, or a dispenser outlet 51. As illustrated, the dispensing system 54 can be fluidly coupled to the supply conduit 52 via the diverter valve 55 and the first water conduit 56. The faucet 53, coupled to the support structure 80, can be fluidly connected to the first water conduit 56 such that water can be supplied to the treating chamber 32 from the faucet 53 via the access opening 15. A non-limiting example of the liquid supply system fluidly connected to the dispensing system 54 includes the hot water and cold water valves 48, 49 fluidly connected to the supply conduit 52. The supply conduit 52 can be fluidly connected to the diverter valve 55. The diverter valve 55 can direct the hot and/or cold water to the faucet 53, or the tub 34 and/or the one or more drawers 57. Alternatively, another non-limiting example includes the liquid supply system fluidly connected to the dispensing system 54 where the hot water and cold water valves 48, 49 can fluidly connect to the faucet 53 via conduit and an additional water supply line coupling water from the household water supply to the tub 34 and/or one or more drawers 57. It is further understood that the household water supply, the liquid supply system, and the dispensing system 54 can further be fluidly connected using a variety of conduits and valves and is not limited by example or illustration.

The one or more drawers 57 can store laundry treating chemistries and can be detachably or slidably coupled to the support structure 80. The one or more drawers 57 of the dispensing system 54 can include one of a bulk dispenser, a single use dispenser or a combination of a bulk dispenser and single use dispenser for dispensing treating chemistries. When coupled to the support structure 80, in a closed, first position, the one or more drawers 57 can fluidly connect with the dispenser outlet 51 to supply treating chemistries. The dispenser outlet 51 can also fluidly couple to the faucet 53 or to the treating chamber 32.

Non-limiting examples of treating chemistries that can be dispensed by the dispensing system 54 during a cycle of operation include one or more of the following: water, detergents, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

A liquid recirculation system can be provided for recirculating liquid from the tub 34 into the treating chamber 32. More specifically, the sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. In another example, the recirculation conduit 66 can be fluidly connected with various conduits. Various conduits can include, but are not limited to, the supply conduit 52, the first water conduit 56, or the second water conduit 58. Further, the liquid recirculation system can include other types of recirculation systems.

It is noted that the illustrated drive system, suspension system, liquid supply system, and liquid recirculation system are shown for exemplary purposes only and are not limited to the systems shown in the drawings and described above. For example, liquid recirculation system and the liquid supply system can differ from the configuration shown, such as by inclusion of other valves, pumps, conduits, wash aid dispensers, heaters, sensors, such as water level sensors and temperature sensors, and the like, to control the flow of treating liquid, (i.e. water or treating chemistries), through the washing machine 10 and for the introduction of more than one type of treating chemistries. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can also be provided with a heating system (not shown) to heat liquid provided to the treating chamber 32. In one example, the heating system can include a heating element provided in the sump to heat liquid that collects in the sump 60. Alternatively, the heating system can be in the form of an in-line heater that heats the liquid as it flows through the liquid supply, dispensing and/or recirculation systems.

The washing machine 10 can further include a controller 70 coupled with various working components of the washing machine 10 to control the operation of the working components and to implement one or more treating cycles of operation. A user interface 26 can be operably coupled with the controller 70. The user interface 26 can include one or more knobs, dials, switches, push buttons, displays, touch screens and the like for communicating with the user, such as to receive input and provide output. The user can enter different types of information including, without limitation, cycle selection and cycle parameters, such as cycle options.

A secondary user interface 50 can be operably coupled with the controller 70. The secondary user interface 50 can include one or more knobs, dials, switches, push buttons, displays, touch screens and the like for communicating with the user, such as to receive input and provide output. For example, through the secondary user interface 50, it is contemplated that the user can activate the faucet 53 or the dispenser outlet 51, or both the faucet 53 and the dispenser outlet 51 independent of an automatic cycle of operation.

The controller 70 can include the machine controller and any additional controllers provided for controlling any of the components of the washing machine 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
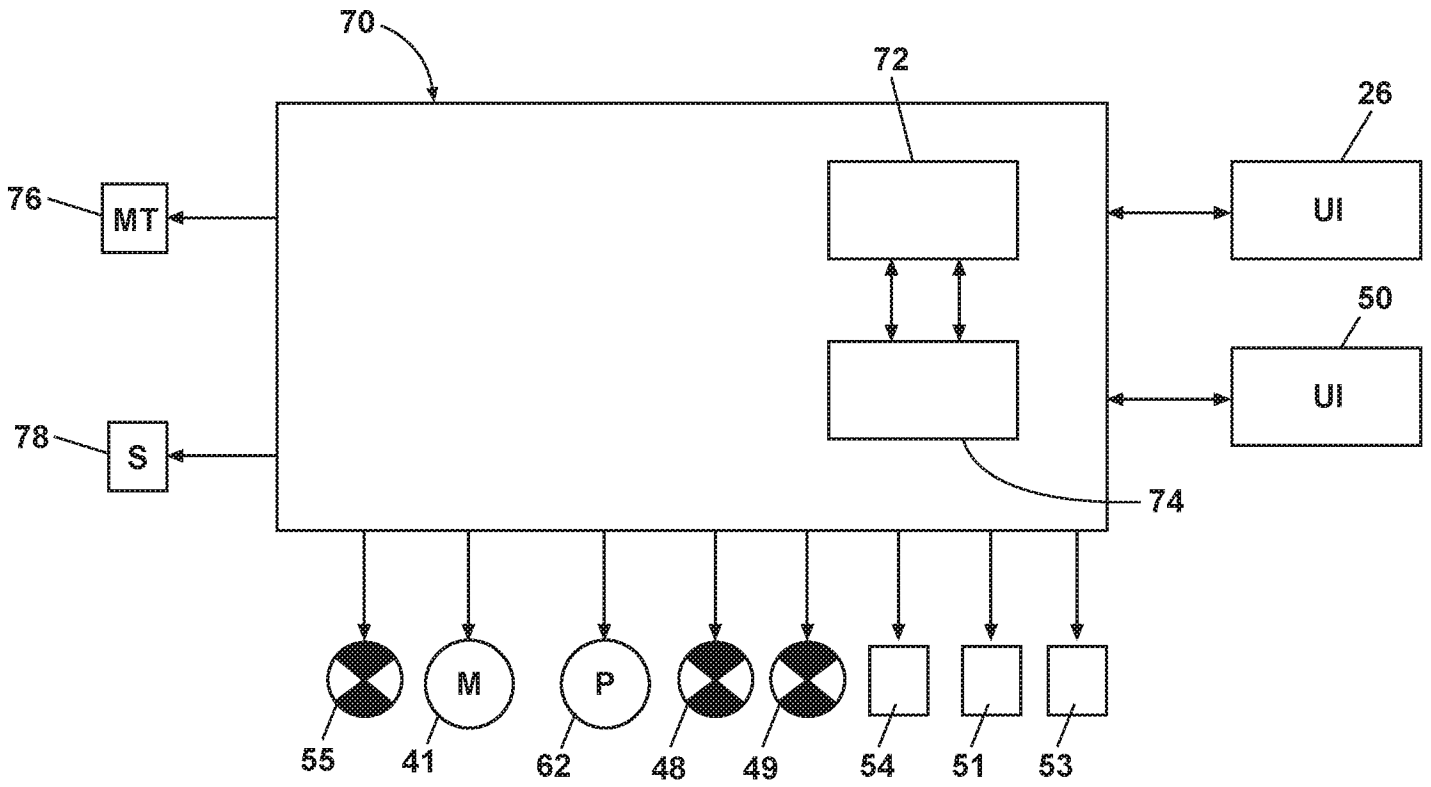
FIG. 2 is a schematic view of a control system of the laundry treating appliance of FIG. 1 according to the present disclosure.

As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. Examples, without limitation, of treating cycles of operation include: wash, heavy-duty wash, delicate wash, quick wash, pre-wash, refresh, rinse only, and timed wash, which can be selected at the user interface 26. The memory 72 can also be used to store information, such as a database or table, and to store data received from the one or more components of the washing machine 10 that can be communicably coupled with the controller 70. The database or table can be used to store the various operating parameters for the one or more cycles of operation, including factory default values for the operating parameters and any adjustments to them by the control system or by user input.

The controller 70 can be operably coupled with one or more components of the washing machine 10 for communicating with and/or controlling the operation of the components to complete a cycle of operation. For example, the controller 70 can be coupled with the hot water valve 48, the cold water valve 49, and the diverter valve 55 for controlling the temperature and flow rate of treating liquid into the treating chamber 32. The controller 70 can also be coupled to the dispensing system 54, the secondary user interface 50, the faucet 53, and the dispenser outlet 51 for controlling treating liquid through the faucet or dosing of treating chemistries through the dispenser outlet 51. The controller 70 can also can also couple to the pump 62 for controlling the amount of treating liquid in the treating chamber 32 or sump 60. Additionally, the controller 70 can couple to the drive system 40 at the motor 41 for controlling the direction and speed of rotation of the basket 30 and/or the laundry mover 38. The user interface 26 and secondary user interface 50 can also couple to the controller 70 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include a weight sensor and a motor torque sensor.

Figure 3:
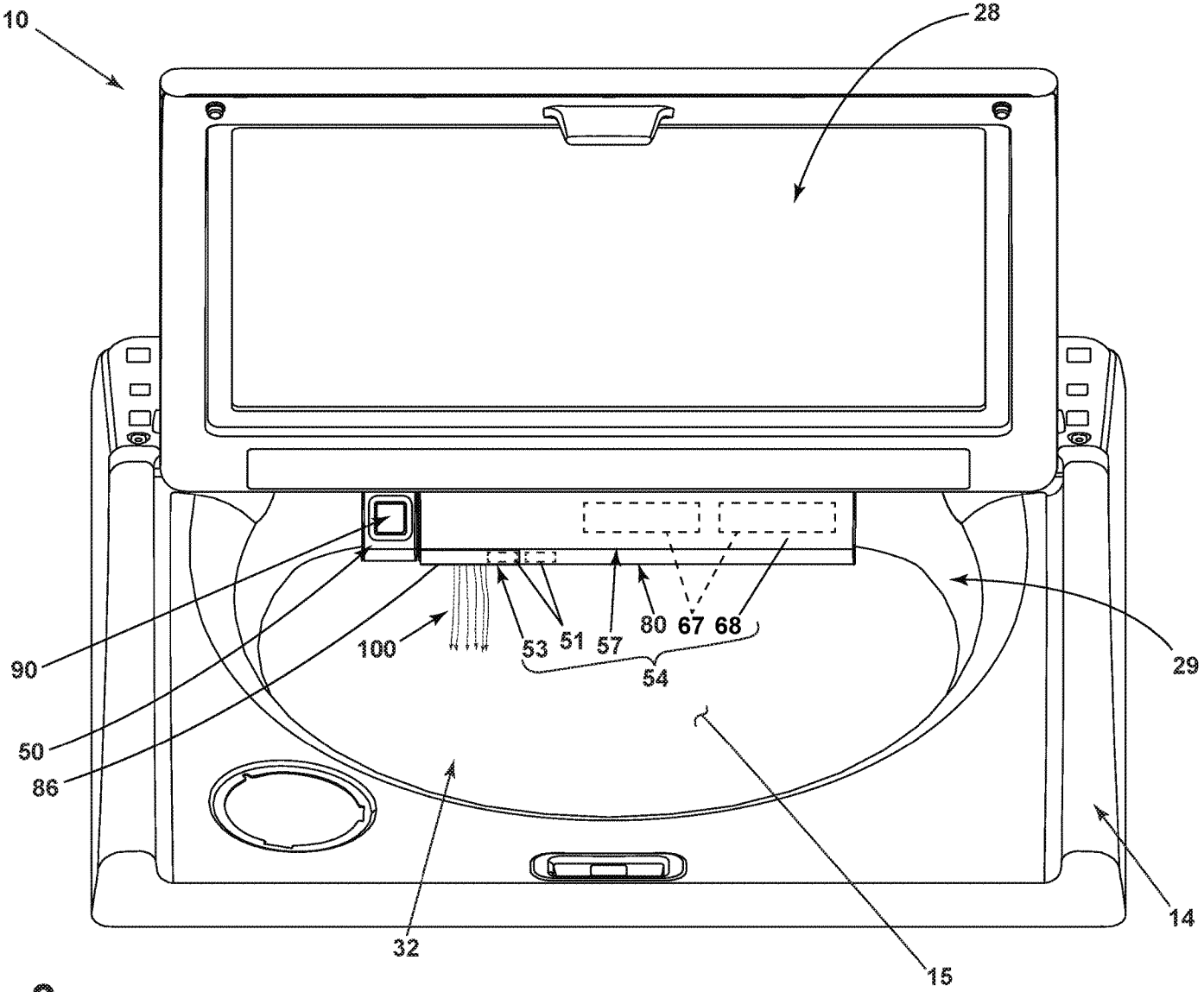
FIG. 3 is a top perspective view of a portion of a laundry treating appliance according to the present disclosure.

Looking now at the dispensing system 54 in greater detail, reference is made to FIG. 3, which illustrates a top perspective view of a washing machine 10 showing the dispensing system 54 wherein the faucet 53 is coupled to the support structure 80. For ease of viewing, the lid 28 is shown in the opened position to illustrate the relative positions of the dispensing system 54, shroud 29 and access opening 15. More specifically, the dispensing system 54 can be provided in (and can partially form) the shroud 29 toward the rear of the access opening 15, although any other suitable position of the components of the dispensing system 54 is contemplated.

The dispensing system 54 can include the one or more drawers 57 movable or slidable between the closed, first position (FIG. 3) and an opened, second position, relative to the shroud 29. The one or more drawers 57 of the dispensing system 54 can further include a front panel 68, which forms a portion of the shroud 29 in the closed, first position.

The faucet 53 can be coupled to the support structure 80. The faucet 53 can underlie the shroud 29 or the one or more drawers 57. The faucet 53 has an outlet 86 provided below the front panel 68 of the one or more drawers 57. A supply of water 100 can be provided from the faucet 53 at the outlet 86, and dispensed to the treating chamber 32 through the access opening 15. The faucet 53 can be a user selectable pre-treating faucet. The faucet 53 can also be controlled by the controller 70 as part of an automatic cycle of operation.

The dispenser outlet 51 couples to the support structure 80 and fluidly communicates with the one or more drawers 57, where the one or more drawers 57 can be fluidly coupled to or define a portion of the at least one treating chemistry reservoir 67. The dispenser outlet 51 is shown in fluid communication with the faucet 53. According to the disclosure, the dispenser outlet 51 can fluidly connect to the supply of water 100 or treating chamber 32. The dispenser outlet 51 can be activated by a user for pre-treating laundry items. The dispenser outlet 51 can also be controlled by the controller 70 as part of an automatic cycle of operation.

The secondary user interface 50 can operably couple to the dispensing system 54 to control the supply of water 100 from the faucet 53. The secondary user interface 50 can also operably couple to the dispenser outlet 51 of the dispensing system 54 to control the supply of treating chemistries via the dispenser outlet 51. A user can operate the secondary user interface 50 to utilize the faucet 53, utilize the dispenser outlet 51, or utilize the faucet 53 and the dispenser outlet 51 concurrently for the pre-treating of laundry items. In this illustrative example, an actuator on the secondary user interface 50 is in the form of a push button 90. The push button 90 can be a mechanical actuator wherein the supply of water 100 or treating chemistries via the dispenser outlet 51 is controlled by way of a mechanical operation, or the push button 90 can be an electrical actuator wherein the supply of water 100 or treating chemistries via the dispenser outlet 51 is controlled by way of an electric signal or current. The secondary user interface 50 can also comprise more than one actuating element. The push button 90 can be any number or combination of suitable actuable elements, such as one or more touch screens, switches, buttons, dials, or knobs. Alternatively, it is contemplated that any suitable operable control mechanism be used to control the supply of water 100 from the faucet 53 or treating chemistries via the dispenser outlet 51. Further, the dispenser outlet 51 can be a single outlet or, as shown in FIG. 3, the dispenser outlet 51 can be multiple outputs. One or more chemistries can be dispensed through one or more outlets of the dispenser outlet 51.

The secondary user interface 50 is shown as being located on the shroud 29. Alternatively, the secondary user interface 50 can be any other suitable location accessible by a user, such as, but not limited to, on the cabinet 14, one or more drawers 57, the front panel 68, the support structure 80, or user interface 26.

Figure 4:
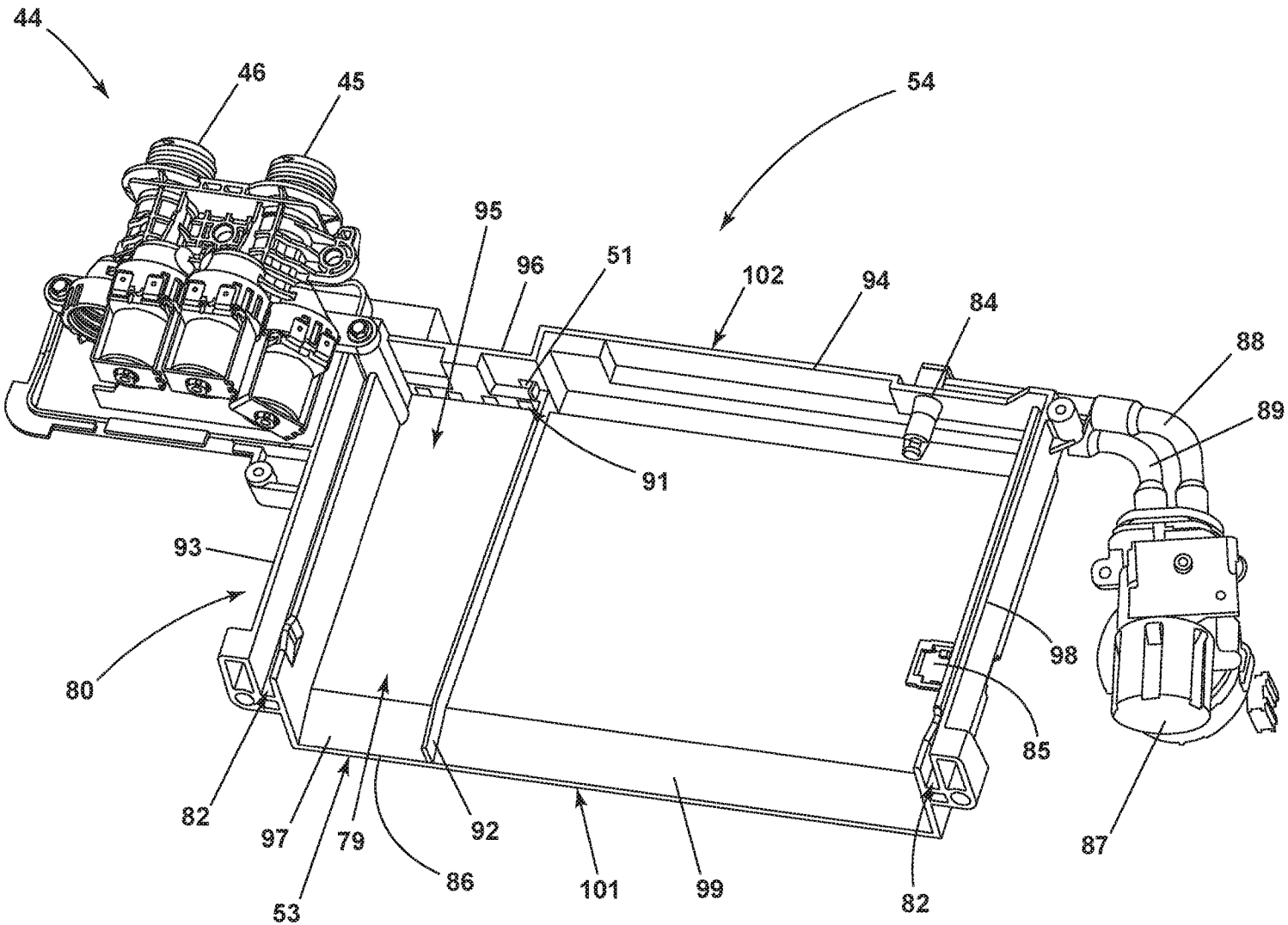
FIG. 4 is a top perspective view of a dispenser having at least first and second treating chemistries reservoirs fluidly coupled to a faucet for use with the laundry treating appliance of FIG. 1 according to the present disclosure.

FIG. 4 illustrates a top view of the dispensing system 54 wherein the one or more drawers 57 is removed to reveal the support structure 80. The support structure 80 can include a left end wall 93, a right end wall 98, a rear wall 102, a base 101, and a divider 92. The left end wall 93 and the right end wall 98 include left and right guide areas 82. The left and right guide areas 82 are configured to allow the one or more drawers 57 to slidably or detachably couple to the support structure. The one or more drawers 57 can be configured to hold treating chemistries. The one or more drawers 57 can be configured to be slidable and detachable from the support structure 80 via the left and right guide areas 82 to allow for filling, refilling, or replacing various treating chemistries or cartridges that couple to or are stored in at least one treating chemistry reservoir 67 of the one or more drawers 57.

The rear wall 102 includes a first rear wall portion 94 and a second rear wall portion 96. The first rear wall portion 94 can include one or more dispenser drawer outlet(s) 84. When the one or more drawers 57 are in the closed, first position, the one or more drawers 57 fluidly couple to the dispenser outlet 51 to allow treating chemistries to be dispensed. In more detail, when the one or more drawers 57 are in the closed position, the one or more dispenser drawer outlet(s) 84 fluidly couples the one or more drawers 57 to at least one chemistry outlet 88. The at least one chemistry outlet 88 can be at least partially coupled to the rear wall 102 and fluidly coupled to a treating chemistries pump 87. The treating chemistries pump 87 is in fluid communication with at least one chemistry inlet 89 that can also be at least partially coupled to the rear wall 102. The at least one chemistry inlet 89 fluidly couples to the dispenser outlet 51. The dispenser outlet 51 can be located on the second rear wall portion 96.

The base 101 can be divided into a first base portion 97 and a second base portion 99 by the divider 92, where the first base portion 97 and the divider 92 are boundaries for an element of the faucet 53. The faucet 53 is in fluid communication with the hot and cold water inlets 45, 46 to provide water to the treating chamber 32. The faucet 53 can be located on top of the support structure 80 and underlie the one or more drawers 57. The faucet 53 includes one or more water outlets 91, the fluid flow path 95, and the outlet 86. The one or more water outlets 91 are located on the second rear wall portion 96 in such a way that water from the water outlets 91 can mix with treating chemistries from dispenser outlet 51. The fluid flow path 95 is within a channel 79. The channel 79 can be defined by the second rear wall portion 96, the left end wall 93, the divider 92, and the first base portion 97 of the support structure 80. The fluid flow path 95 can fluidly couple the one or more water outlets 91, the dispenser outlet 51, or the one or more water outlets 91 and the dispenser outlet 51 to the treating chamber 32 via the outlet 86.

The second base portion 99 of the support structure 80 can include a connecting area 85 that allows the support structure 80 to couple to one or more of the additional sensors 78. In a non-limiting example, the additional sensors 78 coupled to the support structure 80 can detect a fluid level of the treating chemistries in the one or more drawers 57. The controller 70 can provide feedback based on information from the additional sensors 78 via the user interface 26 or secondary user interface 50. The support structure 80 can include more than one connecting area 85 and can couple to a variety of sensors, probes, conduits, and other structures and devices known in the art.

Alternatively, a variety of other locations and orientations of the water outlets 91, the connecting area 85, the divider 92, the fluid flow path 95, and the dispenser outlet 51 coupled to the support structure 80 can also be contemplated.

In operation, when the lid 28 is open, the dispensing system 54 is accessible and enables a user to activate the faucet 53 or the dispenser outlet 51 to dispense water, treating chemistries, or a mixture of water and treating chemistries onto laundry items for treatment prior to or in place of an automatic cycle of operation. A laundry item can be placed underneath the faucet 53 in the trajectory of the supply of water 100 flowing over or out of the outlet 86. Additionally or alternatively, a user can choose to use the dispensing system 54 for functions similar to a utility sink; as the user can choose to activate the faucet 53 or the dispenser outlet 51 to dispense water, treating chemistries, or a mixture of water and treating chemistries that will flow, if unimpeded, into the treating chamber 32.

When a user activates the faucet 53, water flows from one or both of the hot water inlet 45 or the cold water inlet 46 and through one or both of the hot water valve 48 or the cold water valve 49. From there, the water flows into the dispensing system 54. The dispensing system 54 can include additional conduit and valves, such that the first water conduit 56 is fluidly connected to the faucet 53. According to an aspect of the disclosure, water flows from the faucet 53 and is directed by the support structure 80 to the outlet 86. Alternatively, the support structure 80 can contain conduit such that the conduit is coupled to the support structure 80 below the one or more drawers 57 to fluidly connect the faucet 53 to the outlet 86.

When a user activates the dispenser outlet 51, the chemistries pump 87 draws one or more treating chemistries from the one or more drawers 57 via the at least one or more dispenser drawer outlet(s) 84. Treating chemistries flow through the at least one or more dispenser drawer outlet(s) 84 into the at least one chemistry outlet 88 and through conduit coupled to the chemistries pump 87. The treating chemistries can flow through the at least one chemistry inlet 89 that is fluidly connected to the dispenser outlet 51. According to an aspect of this disclosure, treating chemistries from the dispenser outlet 51 are guided by the support structure 80 to the outlet 86. The faucet 53 can be activated at the same time as the dispenser outlet 51. The dispenser outlet 51 is positioned so that the treating chemistries from the dispenser outlet 51 can mix with the supply of water 100 from faucet 53. In another aspect described herein, a mixture of water and treating chemistries can flow from the outlet 86. Alternatively, just treating chemistries or just water can flow from outlet 86.

In a first example, the user can actuate the push button 90 to activate the faucet 53, starting the supply of water 100. The laundry item can be at least partially saturated with the supply of water 100. The wet laundry treating item can be treated by the user, such as rubbing or brushing a stain on the wet laundry item. A second actuation of the push button 90 can begin the administration of a predetermined amount of treating chemistries from the dispensing outlet 51 where the treating chemistries from the dispenser outlet 51 mix with the supply of water 100. The user can continue treating the laundry item with a mixture of water and treating chemistries. A third actuation of the push button 90 can turn the faucet 53 and the dispenser outlet 51 off.

In another example, the user can actuate the push button 90 to start the supply of water 100 from the faucet 53 and treating chemistries from the dispenser outlet 51 where the treating chemistries from the dispenser outlet 51 mix with the supply of water 100. A second actuation of the push button 90 can turn the faucet 53 and the dispenser outlet 51 off.

In another example, the secondary user interface 50 can include the push button 90 and an auxiliary push button (not shown). The user can actuate the push button 90 to start the supply of water 100 from the faucet 53. A second actuation of the push button 90 can turn the faucet 53 off. The user can actuate the auxiliary push button to obtain a single surge of a predetermined amount of treating chemistries from the dispenser outlet 51. A second actuation of the auxiliary push button will supply reoccurring surges of predetermined amount of treating chemistries in predetermined time intervals. A third actuation of the auxiliary push button can turn the dispenser outlet 51 off. A user can then activate the faucet 53 and the dispenser outlet 51 to obtain any combination of water, treating chemistries, or a mixture of water and treating chemistries to pretreat a laundry item.

These are non-limiting examples where any combination of the one or more actuating controls to control the supply of water 100 or treating chemistries from the dispenser outlet 51 or to control the amount of water of treating chemistries is realized.

Further non-limiting examples include additional dials/actuators to control the temperature of the supply of water 100, the volume of the supply of water 100, the amount of treating chemistries dispensed through the dispenser outlet 51, or the frequency of treating chemistries dispensed through dispenser outlet 51.)

After the lid 28 is closed and the washing machine 10 begins an automatic cycle of operation, the faucet 53 or dispenser outlet 51 can be used as part of an automatic cycle of operation. Alternatively, treating chemistries in the one or more drawers 57 can be fluidly coupled to the treating chamber 32 by a means other than the dispenser outlet 51 during the automatic cycle of operation. Alternatively, the water supply system 44 can fluidly couple to the treating chamber 32 via the second water conduit 58 during the automatic cycle of operation.

Figure 5:
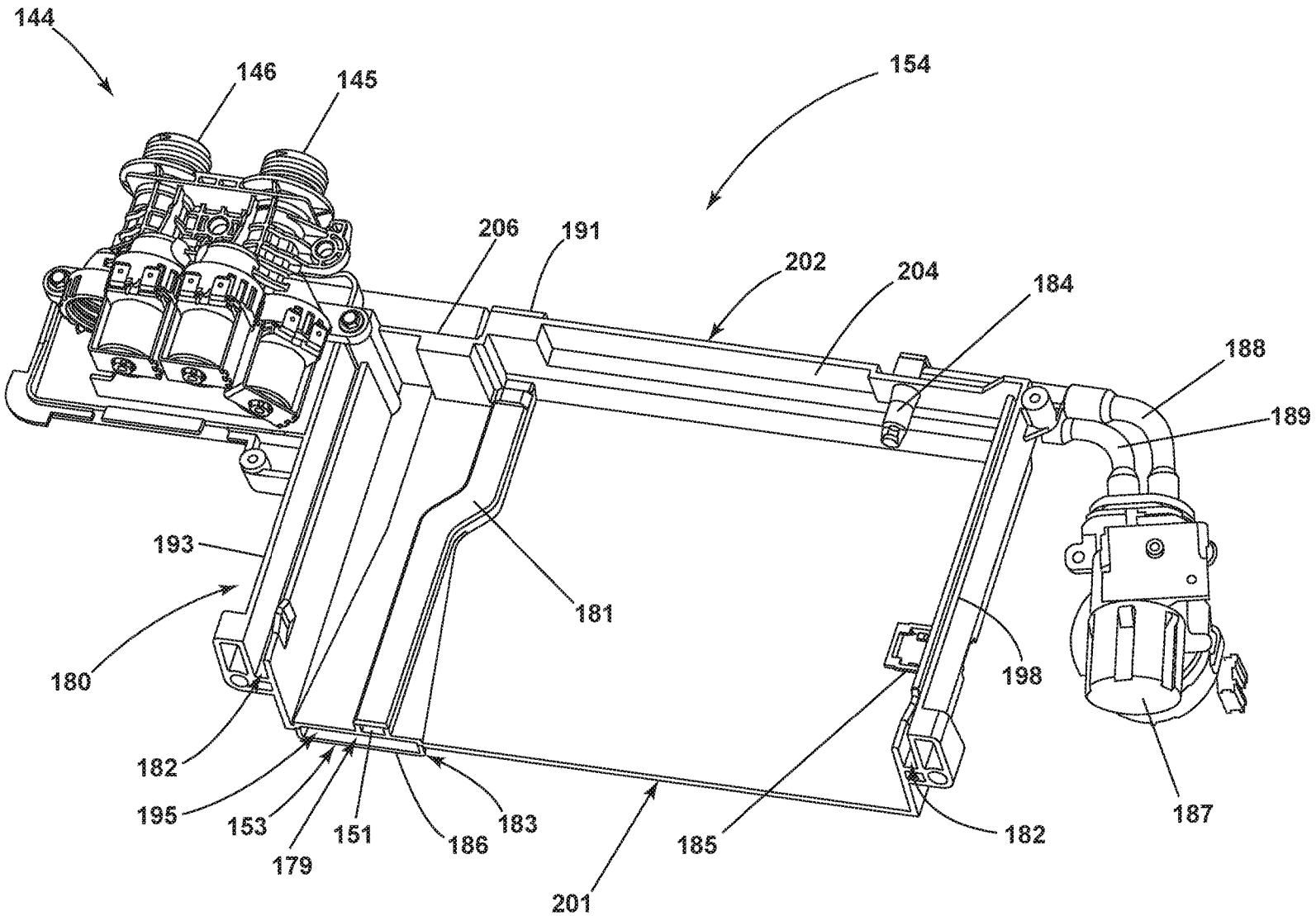
FIG. 5 is a top perspective view of a dispenser having at least first and second treating chemistries reservoirs fluidly coupled to a faucet for use with the laundry treating appliance of FIG. 1 according to the present disclosure.

FIG. 5 illustrates a top view of a dispensing system 154 and a support structure 180 according to another aspect of the disclosure discussed herein. The dispensing system 154 and the support structure 180 are substantially similar to the dispensing system 54 and the support structure 80 of FIG. 4. Therefore, like parts will be identified with like numerals increased by 100, with it being understood that the description of the like parts of the dispensing system 54 and the support structure 80 apply to the dispensing system 154 and the support structure 180 unless otherwise noted.

The support structure 180 can include a trough 204 in a rear wall 202. The trough 204 can be formed, for non-limiting examples: to receive or support one or more drawers 57; assist in the alignment of the one or more drawers 57 to ensure fluid connection to at least one treating chemistry outlet 188 via the one or more dispenser drawer outlet(s) 184; to provide support for conduit such as at least one chemistry inlet 189. The trough 204 can be a recessed portion of the rear wall 202 that results in a shelf-like structure.

A faucet 153 is coupled to the support structure 180. The faucet 153 includes one or more water outlets 191, a fluid flow path 195, and an outlet 186. The one or more water outlets 191 fluidly connect a water supply system 144 to the fluid flow path 195 at a rear wall interface 206. The fluid flow path 195 is within a channel 179. The channel 179 can be defined by a faucet conduit 183 with an outlet 186. As will be further described, the faucet conduit 183 can be coupled beneath a base 201 of the support structure 180. The fluid flow path 195 can fluidly couple the one or more water outlets 191 to the treating chamber 32 via the outlet 186.

The one or more dispenser drawer outlet(s) 184 of the support structure 180 fluidly connects to the at least one treating chemistry outlet 188 that can be coupled to a treating chemistries pump 187. The treating chemistries pump 187 is also fluidly connected to the at least one chemistry inlet 189, which is fluidly coupled to a dispenser conduit 181 located above the support structure 180. At least a portion of the at least one treating chemistry outlet 188 and the chemistry inlet can be coupled to the rear wall 202 of the support structure 180. The dispenser conduit 181 couples to a dispenser outlet 151. The dispenser outlet 151 is positioned so that the treating chemistries from the dispenser outlet 151 can mix with water from the faucet 153. In another aspect described herein, a mixture of water and treating chemistries can flow from the dispensing system 154 to the treating chamber 32 via the access opening 15. Alternatively, just treating chemistries can flow from the dispenser outlet 151 to the treating chamber 32 via the access opening 15. Additionally or alternatively, just treating chemistries can flow from the dispenser outlet 151 to a laundry garment for pretreatment. Further, just water can flow the faucet 153 to the treating chamber 32 via the access opening 15.

Figure 6:
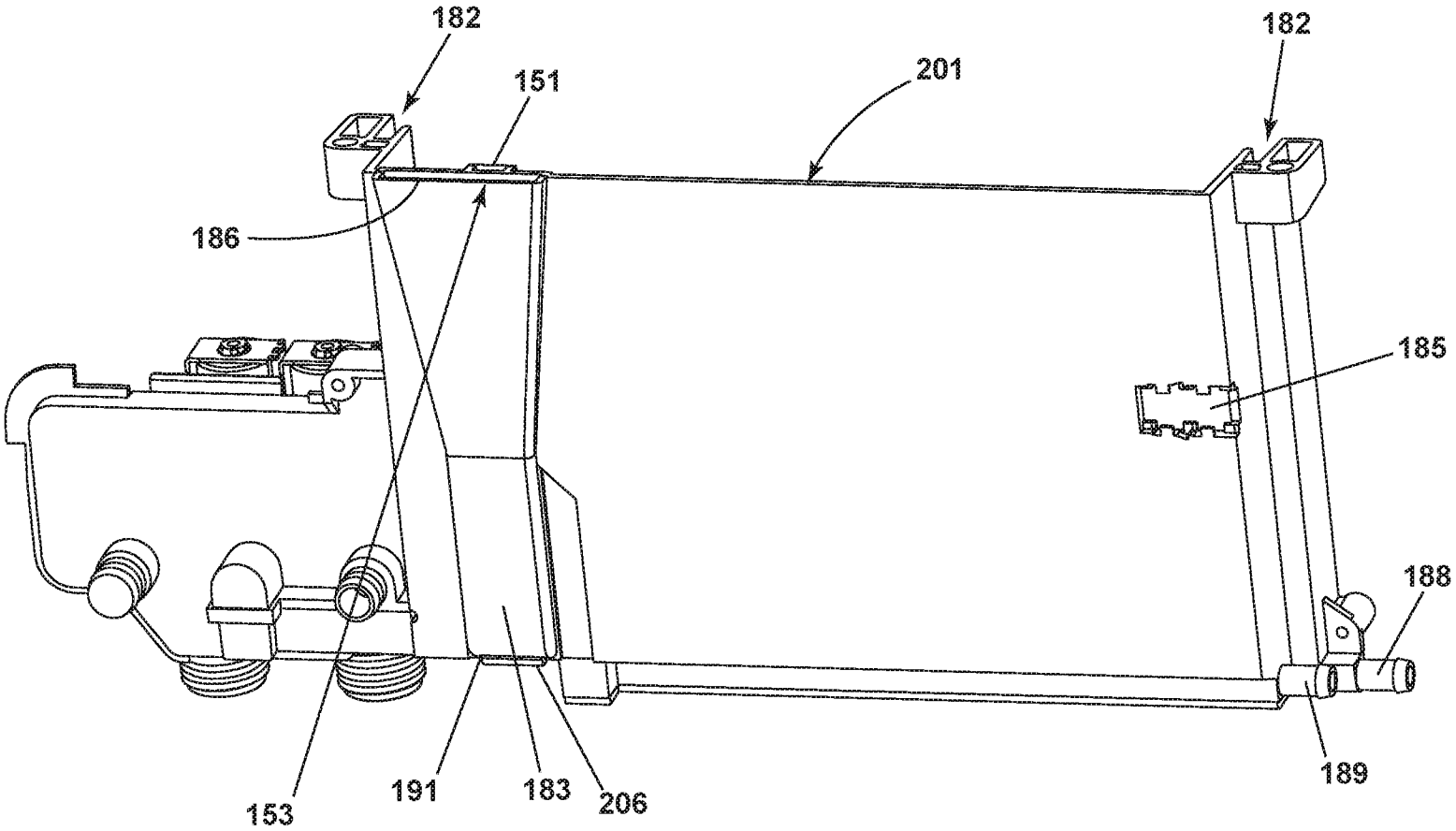
FIG. 6 is a bottom perspective view of a dispenser having at least first and second treating chemistries reservoirs fluidly coupled to a faucet for use with the laundry treating appliance of FIG. 5 according to the present disclosure.

FIG. 6 is a bottom view of the dispensing system 154 and the support structure 180 in FIG. 5. As illustrated, faucet conduit 183 couples to the bottom of the support structure 180 so that the widest portion of the conduit occurs at outlet 186. Alternatively, the faucet conduit 183 could take any shape and be located in a variety of positions in relationship to the support structure 180.

As illustrated in FIG. 5 and FIG. 6, a water supply system 144 can flow to the dispensing system 154 and through the faucet conduit 183 to the outlet 186. A variety of other relative locations of the faucet 153, the faucet conduit 183, the outlet 186, and the dispenser outlet 151 coupled to the support structure 180 can also be contemplated. To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

Figure 7:
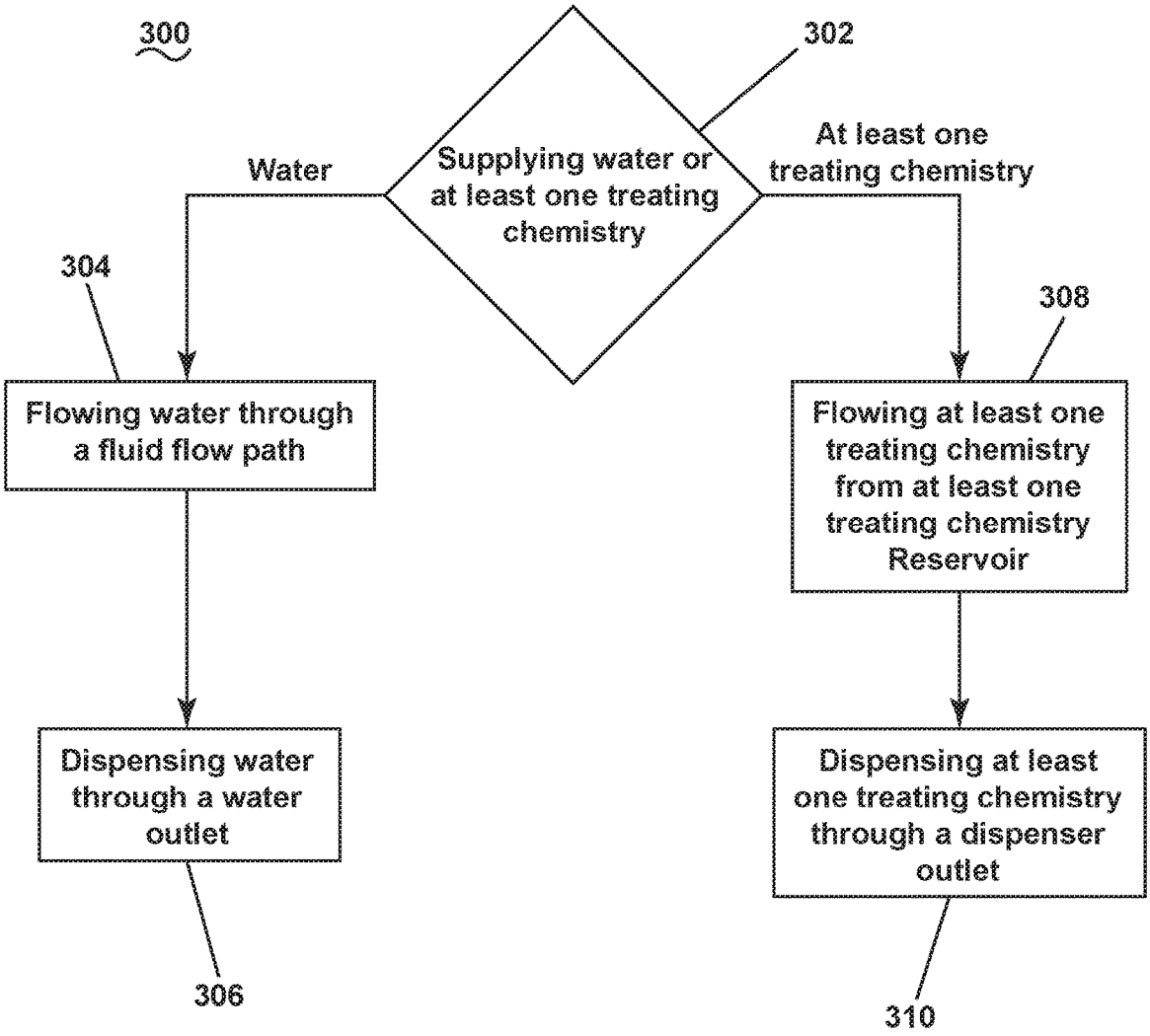
FIG. 7 is a flow chart illustrating a method for dispensing water or at least one treating chemistry into a treating chamber of the laundry treating appliance.

FIG. 7 illustrates a method 300 for dispensing water or at least one treating chemistry into the treating chamber 32 of the washing machine 10. At 302 a supply of water or at least one treating chemistry is supplied to the dispensing system 54, 154 having the dispensing support structure 80, 180 and the at least one treating chemistry reservoir 67. At 304, when water is supplied to the dispensing system 54, 154, from the water inlet 56, the water flows through the one or more water outlets 91, 191 and through the fluid flow path 95, 195 defined at least in part by the dispensing support structure 80, 180. The fluid flow path 95, 195 can be coupled to or defined by the base 101, 201 of the dispensing support structure 80, 180 located beneath the at least one treating chemistry reservoir 67. At 306, the water leaves the fluid flow path 95, 195 and is dispensed through the outlet 86, 186 of the dispensing support structure 80, 180 into the treating chamber 32.

At 308, the at least one treating chemistry can flow from the at least one treating chemistry reservoir 67 through the one or more dispenser drawer outlet(s) 84, 184 to the dispenser outlet 51, 151. At 310, the at least one treating chemistry can be dispensed through the dispenser outlet 51, 151 of the dispensing support structure 80, 180 into the treating chamber 32. The dispenser outlet 51 can fluidly connect to the fluid flow path 95 defined at least in part by the dispensing support structure 80, 180 which fluidly couples the dispenser outlet 51 to the treating chamber 32.

Additionally or alternately, the dispenser conduit 181 can fluidly connect the at least one treating chemistry reservoir 67 to the dispensing outlet 151, where the dispensing outlet 151 is fluidly coupled to the treating chamber 32.

A user can select, steps 304, 306 and steps 308, 310 to be performed independently or simultaneously. The user can make selections pertaining to the method 300 using user interface 26, the secondary user interface 50. It is considered that the user can make selections pertaining to the method 300 using other known user interface assemblies that can include, but are not limited to remote control, voice activation, or motion sensors. Additionally or alternatively, the steps of method 300 can be selected by the controller 50 as part of an automatic cycle.

While the disclosure has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance comprising:

a treating chamber for receiving laundry items for treatment;

a dispensing system having a dispensing support structure for dispensing water and a dispenser drawer including at least one treating chemistry reservoir for dispensing at least one treating chemistry, the dispensing support structure and the at least one treating chemistry reservoir being fluidly coupled to the treating chamber for dispensing the at least one treating chemistry, water, or a mixture of water and the at least one treating chemistry into the treating chamber;

the dispensing support structure comprising a rear wall comprising at least one water outlet, a dispenser outlet, and a dispenser drawer outlet, a front portion defining an outlet, a left end wall, a right end wall, a divider positioned between the left end wall and the right end wall, a planar first base portion extending between the left end wall and the divider and defining a channel extending from the rear wall to the outlet, wherein the at least one water outlet and the dispenser outlet are positioned above the planar first base portion and directly communicate with the channel at the rear wall, and a planar second base portion extending between the right end wall and the divider, wherein the dispenser drawer outlet overlies the planar second base portion;

the dispenser drawer including the at least one treating chemistry reservoir being slideably mounted in the dispensing support structure, wherein the dispenser drawer directly communicates with the dispenser drawer outlet above the second base portion;

a treating chemistry pump having a treating chemistry outlet directly communicating with the rear wall and communicating with the dispenser drawer outlet via the rear wall above the second base portion and a treating chemistry inlet directly communicating with the rear wall and communicating with the dispenser outlet via the rear wall above the first base portion, wherein the pump draws the at least one treating chemistry from the dispenser drawer through the treating chemistry outlet and pumps the at least one treating chemistry through the treating chemistry inlet to the dispenser outlet; and a user interface comprising an actuator operably coupled to the dispensing system for allowing a user to selectively dispense one of the water, the at least one treating chemistry, or the mixture of water and the at least one treating chemistry into the treating chamber;

wherein the dispensing system comprises a fluid flow path for directing water from a water inlet to the at least one water outlet, from the at least one water outlet directly into the channel at the rear wall, and through the channel to the outlet, and directing the at least one treating chemistry from the dispenser outlet directly into the channel at the rear wall and through the channel to the outlet fluidly coupled to the treating chamber for allowing a user to pre-treat laundry stains.

2. The laundry treating appliance of claim 1, wherein the fluid flow path is within the channel.

3. The laundry treating appliance of claim 1, wherein the dispensing system includes one or more of a bulk dispenser or a single-use dispenser for dispensing the at least one treating chemistry.

4. The laundry treating appliance of claim 1, wherein the at least one treating chemistry reservoir is slideably removable from the dispensing support structure.

5. The laundry treating appliance of claim 3, wherein the dispenser outlet is fluidly coupled to the at least one treating chemistry reservoir.

6. The laundry treating appliance of claim 1, wherein the actuator is manual.

7. The laundry treating appliance of claim 1, wherein the actuator is a push button.

8. The laundry treating appliance of claim 7, wherein upon a user pressing the push button activates dispensing water for a predetermined period of time.

9. The laundry treating appliance of claim 7, wherein upon a user pressing the push button twice activates dispensing a predetermined amount of the at least one treating chemistry from the dispenser outlet.

10. The laundry treating appliance of claim 1, wherein the actuator is located on the dispensing system.

11. The laundry treating appliance of claim 1, wherein the water, the at least one treating chemistry, or the mixture of water and the at least one treating chemistry are dispensed from the outlet.

12. The laundry treating appliance of claim 11, wherein the outlet is positioned above the treating chamber.

13. The laundry treating appliance of claim 1, further comprising a second user interface for automatically dispensing one of the water, the at least one treating chemistry or the mixture of water and the at least one treating chemistry during an automatic cycle of operation.

14. The laundry treating appliance of claim 1, wherein the dispenser outlet is positioned adjacent the at least one water outlet on the rear wall.

15. The laundry treating appliance of claim 1, wherein the dispensing system comprises a bulk dispenser.

16. The laundry treating appliance of claim 1, wherein the dispenser drawer is moveable between an open position and a closed position.

17. The laundry treating appliance of claim 16, wherein the dispenser drawer outlet is configured to interface with the dispenser drawer when the dispenser drawer is in the closed position.

18. The laundry treating appliance of claim 1, wherein the dispenser drawer is mounted between the left end wall and the right end wall and is positioned above the divider.

19. The laundry treating appliance of claim 18, wherein the planar first base portion is below the dispenser drawer.

20. The laundry treating appliance of claim 1, further comprising a sensor configured to detect a fluid level of the at least one treating chemistry in the dispenser drawer.

21. The laundry treating appliance of claim 1, wherein the treating chemistry outlet is at least partially positioned along the rear wall.

22. The laundry treating appliance of claim 1, wherein the at least one water outlet and the dispenser outlet are separate, and water dispensed from the water outlet mixes with the at least one treating chemistry dispensed from the dispenser outlet in the channel.

* * * * *